United States Patent [19]

Gerber

[11] 4,407,352

[45] Oct. 4, 1983

[54] HIGH EFFICIENCY COKE OVEN REGENERATOR CHECKER BRICK

[75] Inventor: Donald J. Gerber, Glenshaw, Pa.

[73] Assignee: Koppers Company, Inc., Pittsburgh, Pa.

[21] Appl. No.: 375,444

[22] Filed: May 6, 1982

[51] Int. Cl.[3] ..... F28D 17/00

[52] U.S. Cl. ..... 165/9.1

[58] Field of Search ..... 165/9.1, 9.4, 9.2

[56] References Cited

U.S. PATENT DOCUMENTS

| | | | |
|---|---|---|---|
| 1,173,187 | 2/1916 | Hechenbleikner | 165/9.1 X |
| 2,451,392 | 10/1948 | Kennedy | 165/9.1 |
| 3,220,715 | 11/1965 | Kinney | 165/9.1 |
| 4,108,733 | 8/1978 | Gerber | 165/9.1 X |

FOREIGN PATENT DOCUMENTS

| | | | |
|---|---|---|---|
| 121536 | 12/1918 | United Kingdom | 165/9.2 |

*Primary Examiner*—Albert W. Davis, Jr.

*Attorney, Agent, or Firm*—Daniel J. Long; Herbert J. Zeh, Jr.

[57] ABSTRACT

A high efficiency checker brick for use in a coke oven regenerator. A unique configuration is disclosed which results in the brick having rows of longitudinal slots with vertically corrugated surfaces. The front and rear side surfaces are similarly corrugated, and separator surfaces are provided to space the brick from other bricks so that other vertical gas conveying slots are formed. Although the disclosed brick has an unusually large surface area, it has adequate mass and structural strength and may be manufactured by the economically attractive re-press or dry press methods.

6 Claims, 3 Drawing Figures

HIGH EFFICIENCY COKE OVEN REGENERATOR CHECKER BRICK

BACKGROUND OF THE INVENTION

1. Field of the Invention

The present invention relates to coke ovens and, in particular, to checker bricks used in coke oven regenerators.

2. Description of the Prior Art

It is known that the efficiency of coke oven regenerator bricks may be improved by increasing their surface areas so as to increase the rates at which they absorb heat from hot coke oven waste gases during the waste heat cycle or transfer heat to cooler fuel gas mixtures or air during the heating cycle. A number of limitations, however, exist with respect to increasing the surface area of coke oven regenerator checker bricks since such bricks must have enough mass to retain a sufficient amount of heat and must also have a certain amount of structural strength. It is also important that the brick be not overly expensive to manufacture and that it can preferably be economically made by either the re-press or the dry press method. In the re-press method a viscous refractory material is pushed by a press to form a slug which is then re-pressed into a mold and ejected in the form desired and thereafter dried and then placed directly in a kiln for curing by firing. The dry press method is generally similar to the re-press method except the refractory material inserted in the mold is somewhat less wet. Many refractory forms having intricate cross sections readily crack and crumble during the curing phase of the re-press or dry press methods so that they must be manufactured by the more costly casting method. In the casting method refractory material is poured into a mold in which it must be left for an extended period of time after which the green brick is then ejected from the mold and then heated to drive out moisture after which it is placed in a kiln for curing by firing. The necessity of having to cast a particular refractory shape will significantly add to its cost. It is, therefore, the object of the present invention to provide a high efficiency coke oven regenerator brick which maximizes surface area while maintaining adequate structural strength and mass and which may be manufactured by either the re-press or the dry press method.

SUMMARY OF THE INVENTION

The present invention is a coke oven regenerator brick which has parallel front and rear walls perpendicularly disposed to right and left side walls. Forward and rearward intermediate transverse walls connect the side walls and a row of longitudinal connecting walls connect one of the transverse walls with the front wall to form a forward row of longitudinal slots. A second row of longitudinal connecting walls connect the two transverse walls to form a medial row of slots and another row of connecting walls connect the rearward transverse wall with the rear wall to form still another row of slots. To further increase surface area, the brick surface adjacent the abovementioned slots are vertically corrugated as are the external surfaces of the front and rear and right and left side walls.

BRIEF DESCRIPTION OF THE DRAWINGS

The present invention is further described in the accompanying drawings in which.

DETAILED DESCRIPTION

Figure 1:
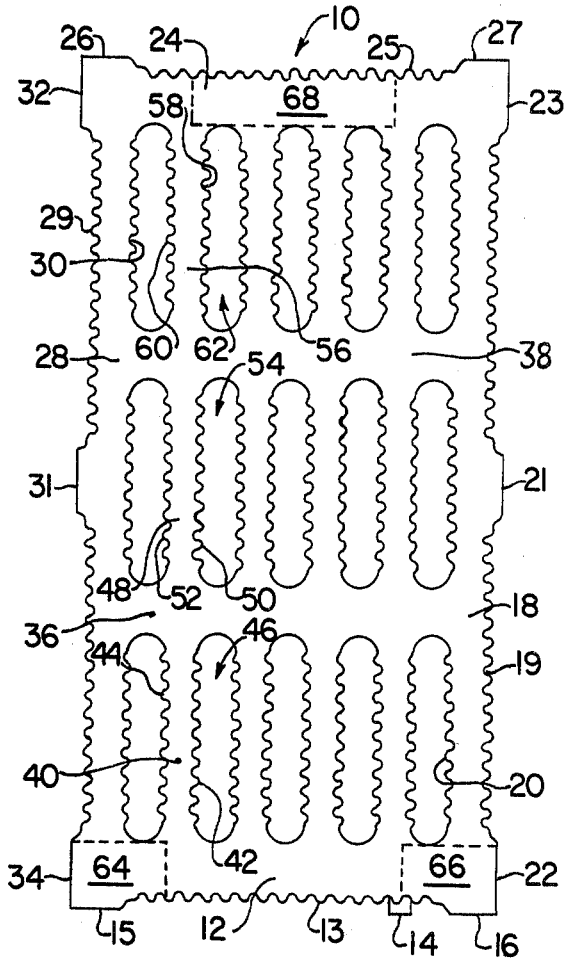
FIG. 1 is a plan view of a coke oven regenerator brick incorporating a preferred embodiment of the present invention.
Figure 2:
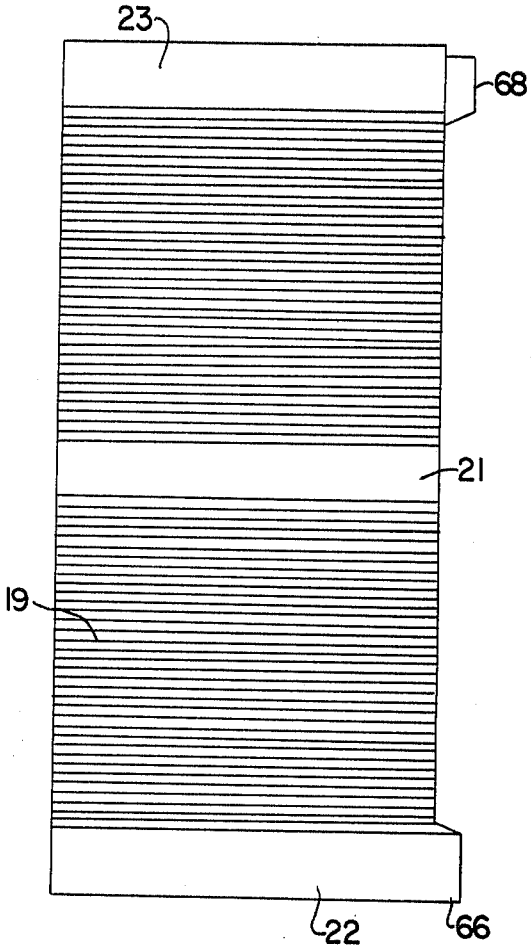
FIG. 2 is a side view of the brick shown in FIG. 1.
Figure 3:
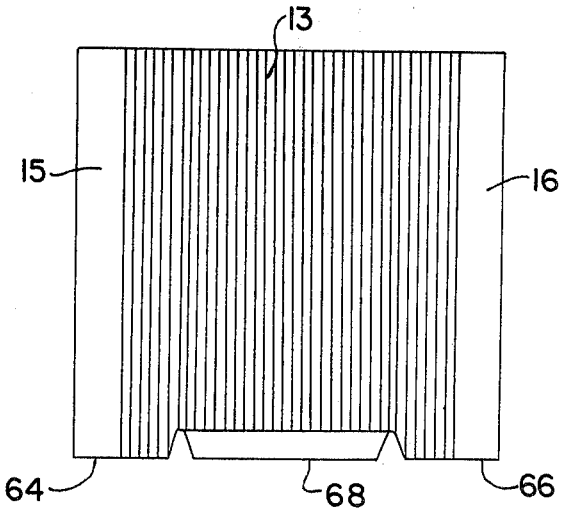
FIG. 3 is an end view of the brick shown in FIG. 1.

Referring to the drawings, a coke oven regenerator brick of conventional dimensions is shown generally at numeral 10. The checker brick 10 has a front wall 12 which has an external face 13 which is corrugated with a plurality of alternate vertical concave and convex configurations as at 14. The radius of each of these configurations is preferably about 1/16 inch. Hereinafter surfaces which are similar to the external face 13 of the front wall will be said to be "vertically corrugated". External face 13 is also characterized by two raised end vertical planar surfaces 15 and 16. The checker brick also has a right side wall 18 which has an external face 19 and an internal face 20 which are vertically corrugated in a manner similar to external face 13 of the front wall except over that portion of the external face on which there is a raised medial vertical planar surface 21 and two raised end vertical planar surfaces 22 and 23. A rear wall 24 has an external face 25 which is vertically corrugated. A left side wall 28 has an external face 29 and an internal face 30 which are also similarly vertically corrugated except over that portion of the external face 29 where there is a raised medial vertical planar surface 31 and two raised end vertical planar surfaces 32 and 34. It will also be observed that the front and rear walls are parallel and are disposed perpendicularly to the parallel right and left side walls.

Between the front and rear walls there is a forward vertical transverse wall 36 and a rearward vertical transverse wall 38. These transverse walls are spaced, respectively, at equal distances from the front and rear walls, and the distance between them is equal to the distance between either the front or rear wall and its adjacent intermediate transverse wall. It will be observed that these intermediate transverse walls connect and are perpendicular to the right and left side walls.

Between the front wall 12 and the forward intermediate transverse wall 36 there are four longitudinal and vertical forward separator walls as at 40. These forward separator walls run parallel to one another and to the right and left side walls. Each of these walls has a right face as at 42 and a left face as at 44, and both these faces are vertically corrugated. These forward separator walls form, with themselves and with the internal faces of the right and left side walls, five vertical forward longitudinal slots as at 46.

Extending between the forward intermediate transverse wall 36 and the rearward intermediate transverse wall 38 there are four longitudinal and vertical medial separator walls as at 48. These medial separator walls run parallel to one another and to the right and left side walls, and each of these walls as at 48 has a right face 50 and a left face as at 52, both of which faces are vertically corrugated. These medial separator walls form, with themselves and with the internal faces of the right and left side walls, five vertical medial longitudinal slots as at 54.

In a like manner, there are, between the rearward intermediate transverse wall 38 and the rear wall 24, four longitudinal and vertical rearward separator walls as at 56. These rearward separator walls run parallel to one another and to the right and left side walls. Each of these walls has a right face as at 58 and a left face as at 60. These rearward separator walls form, with themselves and with the internal faces of the right and left side walls, five vertical rearward longitudinal slots as at 62.

So that a horizontal open space is formed below the brick there is also provided two front risers 64 and 66 and a rear riser 68. While not shown, the rear riser is vertically corrugated on its rearward side. The front risers are also vertically corrugated over part of their front sides.

A plurality of checker bricks similar to checker brick 10 are laid in a coke oven regenerator in horizontal layers in a conventional manner. The raised end vertical planar surfaces as at 15, 16, 26 and 27 abut other such surfaces or the sides of the regenerator so that grooves will be formed adjacent the external faces of the front and rear walls. Similarly, the raised planar surfaces on the side walls will abut other such surfaces or the side of the regenerator so that grooves will be formed adjacent the external faces of the right and left side walls. The checker bricks are also laid so that the longitudinal slots are aligned with longitudinal slots in bricks in the adjacent layers above or below so as to establish in these layers a plurality of vertical, gas conveying flues and creating the least possible amount of obstruction to free flow of gases. It may also be useful to lay one or more layers of bricks transversely with respect to the bricks in the other layers to stabilize the lay-up. It is also found that such transverse layering will tend to establish turbulence in the vertical flues formed by the aligned slots and that a limited amount of surface turbulence in these flues may tend to increase the rate of heat transfer between the bricks and the gases in these flues. It is believed that the brick of the present invention is particularly suited for establishing such limited surface turbulence, and that an approximately ideal amount of turbulence will be established where such bricks are laid transversely at about every fifth course.

In operation hot waste gases are directed downwardly through the aligned longitudinal slots in the checker bricks so as to heat the bricks through the surfaces adjoining these slots. When the gas flow is reversed, cooler fuel gas mixtures or air flow through these aligned slots and are heated through the surfaces adjoining the slots. It is found that the efficiency of the brick of the present invention in receiving and storing heat from hot waste gases and then transferring that heat to cooler gases is high because of its large surface area. By way of a comparison, U.S. Pat. No. 4,108,733, for example, disclosed a coke oven regenerator checker brick having a transverse slot interposed between two rows of longitudinal slots, each of said rows having four parallel slots. It was also disclosed that the surfaces surrounding these slots were vertically corrugated. While this corrugated, transversely slotted brick has a significant advantage in efficiency over conventional coke oven regenerator checker bricks, it has been determineed that the brick of the present invention is still more efficient and that, compared to such a corrugated, transversely slotted brick of similar size, it has a 22 percent greater surface area. Since the brick of the present invention may be manufactured by the re-press or dry press method, it will be appreciated that there has been described a highly efficient coke oven regenerator brick which not only has adequate mass and structural strength but which also may be economically manufactured.

Although the invention has been described herein with a certain degree of particularity, it is to be understood that the present disclosure has been made only as an example and that the scopee of the invention is defined by what is hereinafter claimed.

What is claimed is:

1. A high efficiency coke oven regenerator checker brick, composed of refractory material, comprising:

(a) a vertical front wall, the external face of which is formed of a set of alternate vertical concave and convex radii configurations;

(b) a vertical right side wall, having a greater length than said vertical front wall and projecting rearwardly from the right edge of said front side wall at about a 90° angle, the external and internal faces of which are formed of a set of alternate vertical concave and convex radii configurations;

(c) a vertical rear wall, being equal in length to said vertical front wall and projecting to the left from the rear edge of said right wall at about a 90° angle and running parallel to said front side wall, the external face of which is formed of a set of alternate vertical concave and convex radii configurations;

(d) a vertical left side wall, being equal in length to said vertical right side wall and forming a connection between the left edges of said rear side all and said front wall, projecting from each at about a 90° angle, the external and internal faces of which are formed of a set of alternate vertical concave and convex radii configurations;

(e) forward and rearward intermediate vertical parallel transverse walls perpendicularly connecting said right side wall with said left side wall and spaced at approximately equal intervals, respectively, from said front and rear walls and from one another at a like equal interval;

(f) at least four longitudinal, vertical forward separator walls running parallel to and interposed between said right and left side walls and connecting said front wall and said forward transverse wall and having right and left faces which are formed of a set of alternate vertical concave and convex radii configurations and said front longitudinal separator walls forming with themselves and with the internal faces of said right and left side walls at least five forward longitudinal slots;

(g) at least four longitudinal, vertical medial separator walls running parallel to and interposed between said right and left side walls and connecting said forward and rearward transverse walls and having right and left faces which are formed of a set of alternate vertical concave and convex radii configurations and said medial longitudinal separator walls forming with themselves and with the internal faces of said right and left side walls at least five medial longitudinal slots;

(h) at least four longitudinal, vertical rearward separator walls running parallel to and interposed between said right and left side walls and connecting said rear wall and said rearward transverse wall and having right the left faces which are formed of a set of alternate vertical concave and convex radii configurations and said rearward longitudinal separator walls forming with themselves and with the internal faces of said right and left side walls at least five rearward longitudinal slots; and (i) means, fixed to said checker brick, for elevating said checker brick above an object upon which said checker brick is placed, allowing a horizontal open space between said checker brick and said object upon which said checker brick is placed.

2. The high efficiency coke oven regenerator checker brick defined in claim 1 wherein the external faces of the right and left side walls have a medial raised vertical planar surfaces and two opposed end raised vertical planar surfaces.

3. The high efficiency coke oven regenerator brick defined in claim 1 wherein the external faces of the front and rear walls have two opposed end raised vertical planar surfaces.

4. The high efficiency coke oven regenerator brick defined in claim 1 wherein the alternate vertical radii configurations have radius dimensions of about 1/16 inch.

5. The high efficiency coke oven regenerator brick defined in claim 1 wherein there are four forward separator walls, four medial separator walls and four rearward separator walls and wherein each of said forward separator walls is longitudinally aligned with a medial and an rearward separator wall.

6. A high efficiency coke oven regenerator checker brick as recited in claim 1 wherein said means for elevating said checker brick comprises:

(a) a pair of front risers projecting downwardly from the front wall and positioned at the ends of said front walls; and (b) a rear riser, centrally positioned on the rear wall and projecting downwardly therefrom.

* * * * *